US005784963A

United States Patent [19]

Schmid

[11] Patent Number: 5,784,963

[45] Date of Patent: Jul. 28, 1998

[54] CLEANING DEVICE FOR CLEANING CYLINDERS OF A PRINTING PRESS

[75] Inventor: Gotthard Schmid, Malsch, Germany

[73] Assignee: Heidelberger Druckmaschinen AG, Heidelberg, Germany

[21] Appl. No.: 694,198

[22] Filed: Aug. 8, 1996

[30] Foreign Application Priority Data

Aug. 8, 1995 [DE] Germany ..... 295 12 758 U

[51] Int. Cl.[6] ..... B41F 35/00; B41F 35/02; B41L 41/00

[52] U.S. Cl. ..... 101/425; 101/424

[58] Field of Search ..... 101/425, 424

[56] References Cited

U.S. PATENT DOCUMENTS

| | | | |
|---|---|---|---|
| 2,731,916 | 1/1956 | Koch | 101/425 |
| 3,120,805 | 2/1964 | Simon | 101/425 |
| 3,592,136 | 7/1971 | Selman | 101/425 |
| 3,693,547 | 9/1972 | Morgan | 101/425 |
| 4,439,035 | 3/1984 | Landa | 101/425 |
| 4,841,862 | 6/1989 | Seefried | 101/425 |
| 5,483,879 | 1/1996 | Tani et al. | 101/425 |

FOREIGN PATENT DOCUMENTS

| | | |
|---|---|---|
| 0 004 605 A1 | 10/1979 | European Pat. Off. . |
| 0 381 830 A2 | 8/1990 | European Pat. Off. . |
| 2 267 461 | 12/1993 | United Kingdom . |

*Primary Examiner*—Edgar S. Burr
*Assistant Examiner*—Leslie Grohusky
*Attorney, Agent, or Firm*—Herbert L. Lerner; Laurence A. Greenberg

[57] ABSTRACT

Cleaning device for cleaning cylinders of a printing press includes a pressure member with a cleaning medium assigned thereto, the pressure member being formed as a roller angularly adjustable about a longitudinal central axis thereof, the cleaning medium being disposed on an outer cylindrical surface of the roller.

11 Claims, 1 Drawing Sheet

CLEANING DEVICE FOR CLEANING CYLINDERS OF A PRINTING PRESS

BACKGROUND OF THE INVENTION

Field of the Invention

The invention relates to a cleaning device for cleaning or washing cylinders of a printing press having a pressure member to which a cleaning medium, such as a cleaning cloth especially, is assigned.

Various types of such cleaning devices have become known heretofore. Such cleaning devices serve for cleaning the surfaces of cylinders of printing presses and of coverings mounted on the cylinders, respectively. The aforementioned coverings may include, for example, a blanket of a blanket cylinder or a foil assigned to a plate cylinder for the purpose of having an image formed thereon by a suitable imaging device.

Cleaning devices of the heretofore known types often have the disadvantage that the cleaning medium thereon tends to drift away or to be forced off or even destroyed due to great lateral forces so that the cleaning process cannot be performed properly. Furthermore, cleaning devices have become known heretofore which, after having cleaned a printing plate provided with printing ink, cannot re-use such a printing plate due to the ink contact. With such embodiments, it is always necessary to replace the entire cleaning medium.

SUMMARY OF THE INVENTION

It is accordingly an object of the invention to provide a cleaning device of the aforementioned type for cleaning cylinders of a printing press which is of relatively simple construction and universally applicable.

With the foregoing and other objects in view, there is provided, in accordance with the invention, a cleaning device for cleaning cylinders of a printing press, comprising a pressure member with a cleaning medium assigned thereto, the pressure member being formed as a roller angularly adjustable about a longitudinal central axis thereof, the cleaning medium being disposed on an outer cylindrical surface of the roller.

In accordance with another feature of the invention, the cleaning medium extends over substantially the entire circumferential surface of the roller.

In accordance with a further feature of the invention, the roller is formed with at least one axially extending washing-solution cleaning duct, and at least one radially extending duct branching off therefrom and extending to the cleaning medium.

In accordance with an added feature of the invention, the cleaning medium is formed as a stocking.

In accordance with an additional feature of the invention, the roller and the cleaning medium form an exchangeable unit.

In accordance with yet another feature of the invention, the roller is mounted so as to be reciprocable along the longitudinal central axis thereof.

In accordance with yet a further feature of the invention, the cleaning device includes a driving device assigned to the roller for angularly adjusting the roller about the longitudinal central axis thereof.

In accordance with yet an added feature of the invention, the cleaning device includes a locking mechanism assigned to the roller for preventing the roller from being rotated during a cleaning process performed therewith.

In accordance with yet an additional feature of the invention, the locking mechanism is a ratchet locking mechanism.

In accordance with still another feature of the invention, the cleaning device includes a cleaning element assignable to the outer cylindrical surface of the roller whereon the cleaning medium is disposed.

In accordance with still a further feature of the invention, the cleaning element is formed as a brush.

In accordance with a concomitant feature of the invention, the brush is a roller brush.

With the foregoing construction of the cleaning device according to the invention, it is possible to provide a clean cleaning medium which, upon completion of a cleaning operation, may be used for a subsequent cleaning operation, without any great effort. In this regard, it is necessary only to effect an angular adjustment of the pressure member which is formed as a roller and which carries the cleaning medium, for example, in the form of a cleaning cloth, on the outer cylindrical surface thereof.

In particular, the cleaning medium extends over the entire circumference, or almost over the entire circumference, of the roller. In a manner different from in the state of the art wherein the cleaning medium, preferably formed as a cleaning tape, is guided approximately tangentially over the cleaning member, in the invention of the instant application, the entire circumference, or at least approximately the entire circumference, of the pressure member formed as a roller is used for receiving thereon and supporting the cleaning medium. It is also possible thereby to make available, by means of angular adjustment, a clean portion of the cleaning medium for a subsequent cleaning operation.

According to a further construction of the device of the invention, the roller is formed with at least one washing-solution duct for readily supplying washing solution to the cleaning medium. The washing-solution cleaning duct extends preferably axially, and especially along the longitudinal central axis of the roller. At least one radially arranged duct branching from the washing-solution cleaning duct extends to the cleaning medium. With respect to this application, a "radially arranged duct" also means a duct extending in a direction which is not exactly radial, it being important only to provide a connecting path between the axial washing-solution cleaning duct and the cleaning medium, the exact, generally radial course of the connecting path being of minor importance.

As an alternative, it is, however, also conceivable to assign to the roller a washing-solution container, instead of a washing-solution cleaning duct, so that the roller dips part of the circumferential surface thereof into the washing solution, thereby wetting the cleaning medium with washing solution.

In particular, the cleaning medium may be formed as a stocking or the like, which means that it is wrapped, preferably without out any seam or the like, around the roller serving as a pressure member. Particularly in the case of the cleaning medium being formed as a stocking, the cleaning medium is supplied to the roller axially in order to mount it on the outer cylindrical surface of the roller. The removal of a, respectively, worn and torn and soiled cleaning medium is effected accordingly, thereby permitting a relatively easy exchange of cleaning media. If both the cleaning medium is exchanged and the roller serves as a re-useable pressure member, in a further embodiment of the invention, the roller and the cleaning medium may form an exchangeable unit. In such a case, both the roller and the cleaning medium are exchanged together. Particularly in such a case, the roller is a plastic roller or the like having an outer cylindrical surface which is permanently or especially firmly connected to the cleaning medium.

The invention may preferably provide that the roller be mounted so as to traverse or reciprocate along the longitudinal central axis thereof. During the cleaning operation or process, the roller is moved back and forth along the longitudinal axis thereof due to this traversing or reciprocating arrangement, thereby intensifying or reinforcing the cleaning effect.

In order to make available to the roller a clean portion of the cleaning medium upon the completion of a cleaning operation, a driving device for effecting an angular adjustment of the roller is assigned thereto. This may be a manual driving device permitting an angular adjustment of the roller about the longitudinal axis thereof, or a mechanical adjustment is effected.

In order to fix the rotationally angular position of the roller, whereby the roller is prevented from rotating unintentionally during the cleaning process, a locking mechanism is assigned to the roller. The locking mechanism may be formed, in particular, as a ratchet locking mechanism, which means that, in an engaged or ratcheted condition, the roller is prevented from rotating due to torque being applied during the cleaning process. If a clean cleaning medium is to be made available for a subsequent cleaning operation, the roller is merely rotated through an angle corresponding to the distance occupied by one notch of the ratchet locking mechanism, the roller being then again fixed against rotation in the new position.

Finally, it is advantageous to assign a cleaning element to the outer cylindrical surface of the roller whereon the cleaning medium is disposed. The cleaning element cleans the surface of the cleaning medium so that it may be re-used. The cleaning element preferably is a cleaning brush which, in particular, may be a roller brush. For each cleaning operation or process, the cleaning brush may be rotated. Furthermore, in addition or as an alternative, the cleaning device may be provided with a vacuum device for cleaning the cleaning cloth or other fabric. The vacuum device may preferably have a suction box assignable to the surface area to be cleaned and/or to the brush.

Other features which are considered as characteristic for the invention are set forth in the appended claims.

Although the invention is illustrated and described herein as embodied in a cleaning device for cleaning cylinders of a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
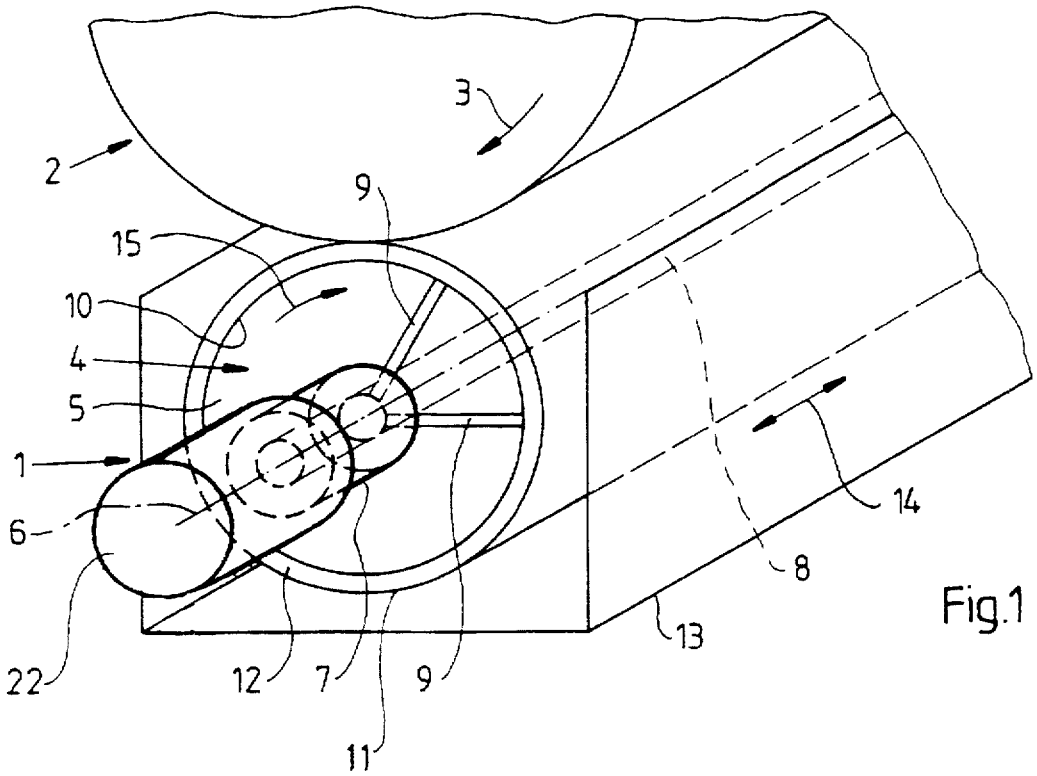
FIG. 1 is a diagrammatic perspective front, side and top view of a cleaning device assigned to a printing-press cylinder to be cleaned.

Referring now to the drawing and, first, particularly to FIG. 1 thereof, there is diagrammatically shown therein a cleaning device 1 engaged with a cylinder 2, for example, a plate cylinder, of an otherwise non-illustrated printing press. The engaged condition of the cleaning device 1 and the cylinder 2 shown in FIG. 1 is effected pneumatically or mechanically by suitable conventional elements not otherwise illustrated in the figures, which permit a displacement of the cleaning device 1 so that it comes into contact with the outer cylindrical surface of the cylinder 2. In order to perform the cleaning process, the cylinder 2 rotates in the direction of an arrow 3.

The cleaning device 1 has a pressure member 4 in the form of a roller 5. The roller 5 is mounted so as to be adjustable angularly about a longitudinal central axis 6 thereof. For this purpose, the roller 5 is provided with journal pins or trunnions 7 mounted in suitable non-illustrated bearings of the printing-press frame. Alternatively, it is also conceivable not to assign the bearings to the printing press but rather to assign them to the cleaning device itself, i.e., the cleaning device 1 is provided with a bearing housing for receiving the roller 5 therein. In particular, the entire cleaning device may be assigned as an independent unit to the printing press through an opening formed in a side wall of the printing press. In such a case, the cleaning device constitutes a compact slide-in unit or module.

In accordance with FIG. 1, a washing-solution cleaning duct 8 extends axially through the roller 5. Radially arranged ducts 9 terminating at the outer cylindrical surface 10 of the roller 5 branch off from the washing-solution cleaning duct 8. Preferably, the radially arranged ducts 9, respectively, are provided, over the axial length of the roller 5, especially angularly offset with respect to one another.

A cleaning medium 11 is provided on the outer cylindrical surface 10 of the roller 5. The cleaning medium 11 preferably extends over the entire circumferential or peripheral surface of the roller 5 so that a seamless structure thereof is provided. Preferably, the cleaning medium 11 is in the form of a stocking 12 which is axially slipped onto the roller 5 and may also be removed in this direction, when the cleaning medium is being changed. The cleaning medium 11 is preferably formed of such material as cloth, plush, fabric or any other suitable covering material which has a good absorption and cleaning capability or capacity.

For protection and for collecting washing-solution which drips off, the roller 5 is surrounded by a container 13. The double arrow 14 indicates that the roller 5 is reciprocably displaceable or traversible along the longitudinal central axis 6 thereof by means of an otherwise non-illustrated conventional driving device. Thus, during the cleaning process, the roller 5 is reciprocable, thereby reinforcing the cleaning action.

For performing the cleaning process, the cleaning device 1 is displaced towards the cylinder 2 to be cleaned so that the cleaning medium 11 comes into contact with the outer cylindrical surface of the cylinder 2. During the cleaning process, the roller 5 assumes a non-rotatable position, thereby setting up a respective relative movement between the cleaning medium 11 and the cylinder 2, so that the cleaning process may take place in the form of a wiping operation. During this process, washing solution is supplied through the washing-solution cleaning duct 8 by means of a suitable feeding device (a pump or the like) and passes through the radially arranged ducts 9 to the cleaning medium 11, thereby wetting the surface thereof. Upon the completion of the cleaning process, the roller 5 is rotated through an angular sector in the direction of an arrow 15 so that a remaining clean portion of the cleaning medium 11 is available in the contact area of the cylinder to be cleaned. This rotation about a respective angular sector is effected by means of a driving device 22 which permits either a manual or a mechanical adjustment. It is also conceivable to provide a mechanical driving device which may also be operatable manually, if necessary.

Figure 2:
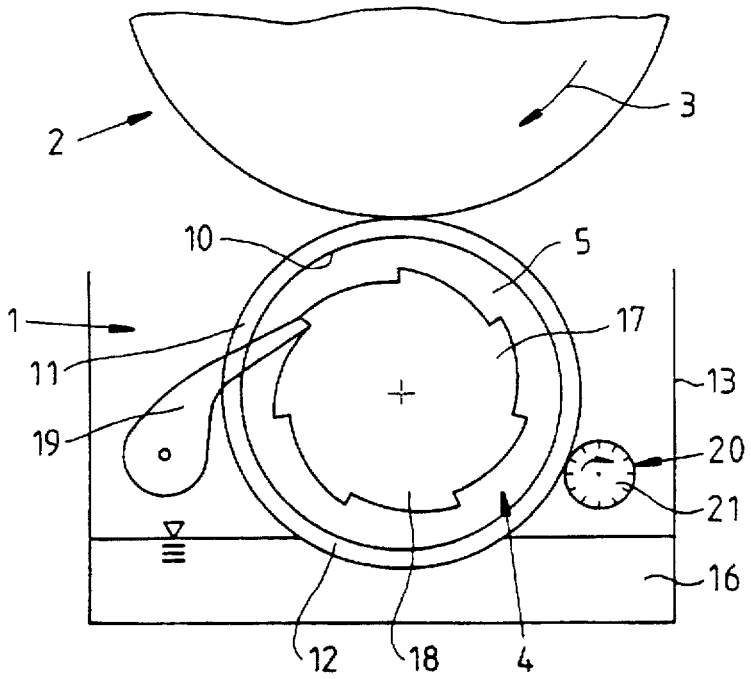
FIG. 2 is a diagrammatic side elevational view of another embodiment of the cleaning device according to the invention.

FIG. 2 shows a further embodiment of the cleaning device 1; only the differences thereof from the embodiment of the cleaning device shown in FIG. 1 being mentioned hereinafter. Thus, FIG. 2 differs from FIG. 1 in that the roller 5 of FIG. 2 is not formed with a washing-solution cleaning duct, the container 13 of FIG. 2 instead serving as a collecting vessel for collecting the washing solution 16, with part of the circumferential or peripheral surface of the roller 5 dipping into the washing solution 16, thereby wetting the cleaning medium 11 disposed on the roller 5.

A locking mechanism 17 having a ratchet wheel 18 and a preferably spring-preloaded pawl 19 is assigned to the roller 5. During the cleaning process, the cleaning device 1 is disposed in engagement with the cylinder 2, as noted hereinbefore, the cylinder 2 being moved in the direction of the arrow 3. The pawl 19 which is engaged in a notch of the ratchet wheel 18 prevents the roller 5 from rotating during the cleaning process. Upon the completion of the cleaning process, the roller 5 is rotated about an angular sector by means of a non-illustrated conventional driving device so that the ratchet 19 engages in the following notch of the ratchet wheel 18, thereby making available a clean portion of the cleaning medium 11 disposed on the roller 5.

A cleaning element 20 which is preferably disposed inside the container 13 is assigned to the cleaning medium 11 of the roller 5. The cleaning element 20 is formed as a roller brush 21 which, for the purpose of cleaning the surface of the cleaning medium 11, may be rotated by means of a non-illustrated conventional drive.

In the exemplary embodiments of FIGS. 1 and 2, provision may be made for displacing the roller 5 through an angular sector during a cleaning process so that initially the coarse dirt is removed and then a fine cleaning is effected with a clean cleaning medium 11. The roller 5 may thus also be rotated several times, i.e., through several angular steps. A cleaning operation is effected between the individual rotational movements due to a roller stop and the frictional motion resulting therefrom. It is also possible to rotate the roller 5 very slowly and, for example, continuously during the cleaning process, thus causing a clean cleaning medium 11 to come into contact with the outer cylindrical surface 10 of the cylinder 2. In this regard, it is of great importance that frictional contact due to the different circumferential speeds of the roller 5 and the cylinder 2 be always maintained.

The different constructions of the embodiments of FIGS. 1 and 2 may, of course, be modified so that, for example, the embodiment of FIG. 1 is provided with a locking mechanism and/or a roller brush is assigned to the embodiment of FIG. 1. Of course, it is also conceivable to provide the embodiment of FIG. 2 with a washing-solution cleaning duct.

The cleaning device is suitable both for removing the scale residue of a re-imageable printing plate as well as for removing ink residues and paper hickies or lint. Preferably, the cleaning device is used when an interruption occurs in the printing process during a production run. The cleaning device may either be permanently assigned to the printing press or may be introduced into the printing press as a separate structural unit only whenever a cleaning process is supposed to be performed.

In accordance with a preferred embodiment of the invention, the roller provided with a cleaning medium may be removed entirely from the cleaning device and exchanged. The cleaning process may be performed under wet conditions as mentioned hereinbefore; however, it is also conceivable to practice the cleaning process under dry conditions. Further cycling or rotation of the roller 5 may be effected electromotively, pneumatically or mechanically, for example.

In addition to the cleaning device formed as a brush, or instead of such a cleaning device, it is also possible to introduce a vacuum device for cleaning the cleaning medium 11 so that the cleaning medium 11 may be used many times. A suction box, for example, may be provided for cooperating with the roller 5 in order to achieve the foregoing objective.

If the cleaning medium 11 is in the form of a stocking which may be slipped onto the roller 5, it may be easily replaced by being slipped off and on, respectively. The service life of such a cleaning medium is increased by providing a cleaning device as hereinafore mentioned. The cleaning device also affords the advantage that the surface area of the cylinder of the printing press to be cleaned is prevented from becoming scratched after a complete rotation of the roller 5, because the outer cylindrical surface of the cylinder does not come into contact with an already greatly soiled surface, but rather with a relatively clean one.

If the roller 5 is exchangeable as a unit, it does not have any exchangeable covering for performing the cleaning process, but rather, the cleaning medium 11 is permanently attached to the roller 5. In such a case, it is possible to clean a roller separately, after having removed it, and to re-use it afterwards. It is also possible to use a roller only once and consign it to waste disposal afterwards.

I claim:

1. Cleaning device for cleaning cylinders of a printing press, comprising:

a pressure member with a cleaning medium assigned thereto, said pressure member being formed as a roller angularly adjustable about a longitudinal central axis thereof, said cleaning medium being disposed on an outer cylindrical surface of said roller, said roller being formed with at least one axially extending washing-solution cleaning duct; and a locking mechanism assigned to said roller for preventing said roller from rotating when said roller engages a cylinder of a printing press.

2. Cleaning device according to claim 1, wherein said cleaning medium extends over substantially the entire circumferential surface of said roller.

3. Cleaning device according to claim 1, wherein said roller includes at least one radially extending duct branching off said washing-solution cleaning duct and extending to said cleaning medium.

4. Cleaning device according to claim 1, wherein said cleaning medium is formed as a stocking.

5. Cleaning device according to claim 1, wherein said roller and said cleaning medium form an exchangeable unit.

6. Cleaning device according to claim 1, wherein said roller is mounted so as to be reciprocable along said longitudinal central axis thereof.

7. Cleaning device according to claim 1, including a driving device assigned to said roller for angularly adjusting said roller about said longitudinal central axis thereof.

8. Cleaning device according to claim 1, wherein said locking mechanism is a ratchet locking mechanism.

9. Cleaning device according to claim 1, including a cleaning element assignable to said outer cylindrical surface of said roller whereon said cleaning medium is disposed.

10. Cleaning device according to claim 9, wherein said cleaning element is formed as a brush.

11. Cleaning device according to claim 10, wherein said brush is a roller brush.

* * * * *